US008454383B2

(12) United States Patent
Paynter et al.

(10) Patent No.: US 8,454,383 B2
(45) Date of Patent: Jun. 4, 2013

(54) SELF GAUGING INSERTION COUPLING COAXIAL CONNECTOR

(75) Inventors: Jeffrey Paynter, St. Momence, IL (US); Nahid Islam, Westmont, IL (US)

(73) Assignee: Andrew LLC, Hickory, NC (US)

( * ) Notice: Subject to any disclaimer, the term of this patent is extended or adjusted under 35 U.S.C. 154(b) by 270 days.

(21) Appl. No.: 12/886,940

(22) Filed: Sep. 21, 2010

(65) Prior Publication Data

US 2011/0021074 A1 Jan. 27, 2011

Related U.S. Application Data

(63) Continuation-in-part of application No. 12/611,095, filed on Nov. 2, 2009, now Pat. No. 7,927,134, which is a continuation-in-part of application No. 12/264,932, filed on Nov. 5, 2008, now Pat. No. 7,806,724.

(51) Int. Cl.
*H01R 9/05* (2006.01)

(52) U.S. Cl.
USPC ..... 439/578

(58) Field of Classification Search
USPC ..... 439/578
IPC ..... H01R 9/0527
See application file for complete search history.

(56) References Cited

U.S. PATENT DOCUMENTS 3,671,926 A 6/1972 Nepovim
3,739,076 A 6/1973 Schwartz
3,744,011 A 7/1973 Blanchenot
3,757,279 A 9/1973 Winston
3,761,870 A 9/1973 Drezin et al.
4,824,400 A 4/1989 Spinner
4,857,015 A 8/1989 Micheals
4,923,412 A 5/1990 Morris
5,059,747 A * 10/1991 Bawa et al. ..... 174/655
5,267,877 A 12/1993 Scannelli et al.
5,322,454 A 6/1994 Thommen
5,352,134 A 10/1994 Jacobsen et al.
5,795,188 A 8/1998 Harwath
5,944,556 A 8/1999 Wlos et al.
5,951,327 A * 9/1999 Marik ..... 439/607.44
5,967,852 A 10/1999 Follingstad et al.
6,019,636 A 2/2000 Langham
6,808,415 B1 10/2004 Montena
6,848,939 B2 2/2005 Stirling
7,011,546 B2 3/2006 Vaccaro (Continued)

OTHER PUBLICATIONS

Tille, Daniel, International Search Report, counterpart PCT application No. PCT/US2010/051792, ISA/EPO, Jun. 9, 2011, European Patent Office, Netherlands.

(Continued)

*Primary Examiner* — Vanessa Girardi
(74) *Attorney, Agent, or Firm* — Babcock IP, PLLC

(57) ABSTRACT

A self-gauging electrical connector for coaxial cables with outer conductors of varied diameters is provided with a clamp ring coupled to a connector body with a bore. A mechanical grip and an electrical contact are retained within the bore. The mechanical grip and the electrical contact engage the outer conductor upon insertion of the outer conductor into the bore. The mechanical grip is displaced radially proportional to an outer diameter of the outer conductor. The electrical contact is displaced radial proportional to the radial displacement of the mechanical grip.

15 Claims, 15 Drawing Sheets

U.S. PATENT DOCUMENTS

| | | | |
|---|---|---|---|
| 7,156,696 | B1 | 1/2007 | Montena |
| 7,249,969 | B2 | 7/2007 | Paynter |
| 7,329,149 | B2 | 2/2008 | Montena |
| 7,335,059 | B2 | 2/2008 | Vaccaro |
| 2005/0164552 | A1 | 7/2005 | Wlos et al. |
| 2009/0325420 | A1 | 12/2009 | Paynter |

OTHER PUBLICATIONS

International search report for counterpart application No. PCT/US2009/063315. Issued on Jun. 22, 1010.

International search report for counterpart application No. PCT/US2009/063320. Issued on Jun. 22, 1010.

* cited by examiner

SELF GAUGING INSERTION COUPLING COAXIAL CONNECTOR

CROSS REFERENCE TO RELATED APPLICATIONS

This application is a continuation-in-part of commonly owned U.S. Utility patent application Ser. No. 12/611,095, titled "Insertion Coupling Coaxial Connector", filed Nov. 2, 2009 by Jeffrey Paynter and Al Cox, currently pending, hereby incorporated by reference in its entirety, which is a continuation-in-part of commonly owned U.S. Utility patent application Ser. No. 12/264,932, titled "Insertion Coupling Coaxial Connector", filed Nov. 5, 2008 by Jeffrey Paynter and Al Cox, currently pending, hereby incorporated by reference in its entirety.

BACKGROUND

1. Field of the Invention

This invention relates to electrical cable connectors. More particularly, the invention relates to a coaxial cable connector capable of self-gauging for coupling to coaxial cables of varied diameters.

2. Description of Related Art

Coaxial cable connectors are used, for example, in communication systems requiring a high level of precision and reliability.

To create a secure mechanical and optimized electrical interconnection between the cable and the connector, it is desirable to have generally uniform, circumferential contact between a leading edge of the coaxial cable outer conductor and the connector body. A flared end of the outer conductor may be clamped against an annular wedge surface of the connector body, via a coupling nut. Representative of this technology is commonly owned U.S. Pat. No. 5,795,188 issued Aug. 18, 1998 to Harwath.

Machine threaded coupling surfaces between the metal body and the coupling nut of U.S. Pat. No. 5,795,188 and similarly configured prior coaxial connectors significantly increase manufacturing costs and installation time requirements. Another drawback is the requirement for connector disassembly, sliding the back body over the cable end and then performing a precision cable end flaring operation, which retains the cable within the connector body during threading. Further, care must be taken at the final threading procedure and/or additional connector element(s) added to avoid damaging the flared end portion of the outer conductor as it is clamped between the body and the coupling nut to form a secure electrical connection between the outer conductor and the coaxial cable.

Alternative coaxial connector solutions, utilizing gripping/and or support elements about which the connector body is then radially crimped and/or axially compressed to secure an electromechanical interconnection between the outer conductor of the coaxial cable and the connector, are also known in the art. Crimped and/or compressed connections may be subject to varying quality depending upon the specific force level applied by the installer in each instance. Support surfaces added to prevent collapse of the outer conductor inserted within the inner diameter of the outer conductor, common in connectors for non-solid outer conductor coaxial cables, introduce an electrical performance degrading impedance discontinuity into the signal path. Further, crimping and/or compression becomes impractical with larger diameter coaxial cables, as the increased diameter, sidewall thickness and/or required travel of the corresponding connector/back body(s) increases the required force(s) beyond the levels deliverable by conventional crimp/compression hand tools.

Competition in the coaxial cable connector market has focused attention on improving electrical performance and minimization of overall costs, including materials costs, training requirements for installation personnel, reduction of dedicated installation tooling and the total number of required installation steps and or operations.

Therefore, it is an object of the invention to provide a coaxial cable connector that overcomes deficiencies in the prior art.

BRIEF DESCRIPTION OF THE DRAWINGS

The accompanying drawings, which are incorporated in and constitute a part of this specification, illustrate embodiments of the invention, where like reference numbers in the drawing figures refer to the same feature or element and may not be described in detail for every drawing figure in which they appear and, together with a general description of the invention given above, and the detailed description of the embodiments given below, serve to explain the principles of the invention.

DETAILED DESCRIPTION

Figure 1:
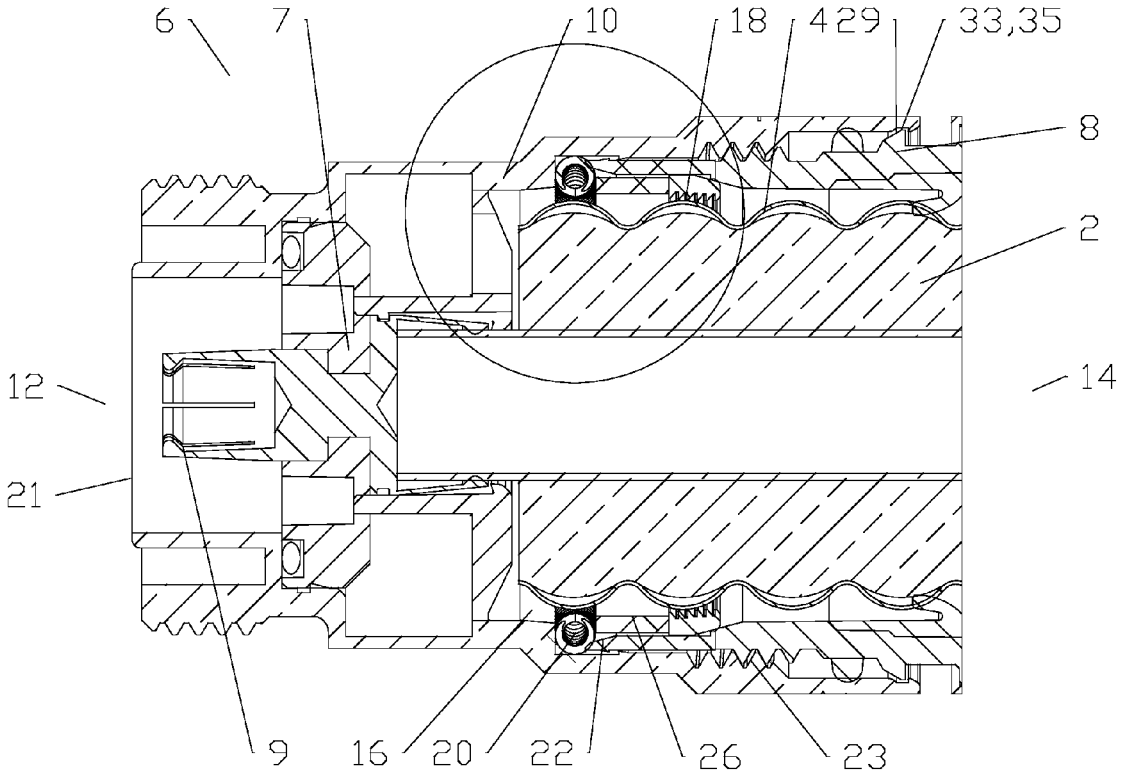
FIG. 1 is a schematic cutaway side view of an exemplary embodiment of an electrical connector with a coaxial cable inserted, prior to clamp ring advance.
Figure 2A:
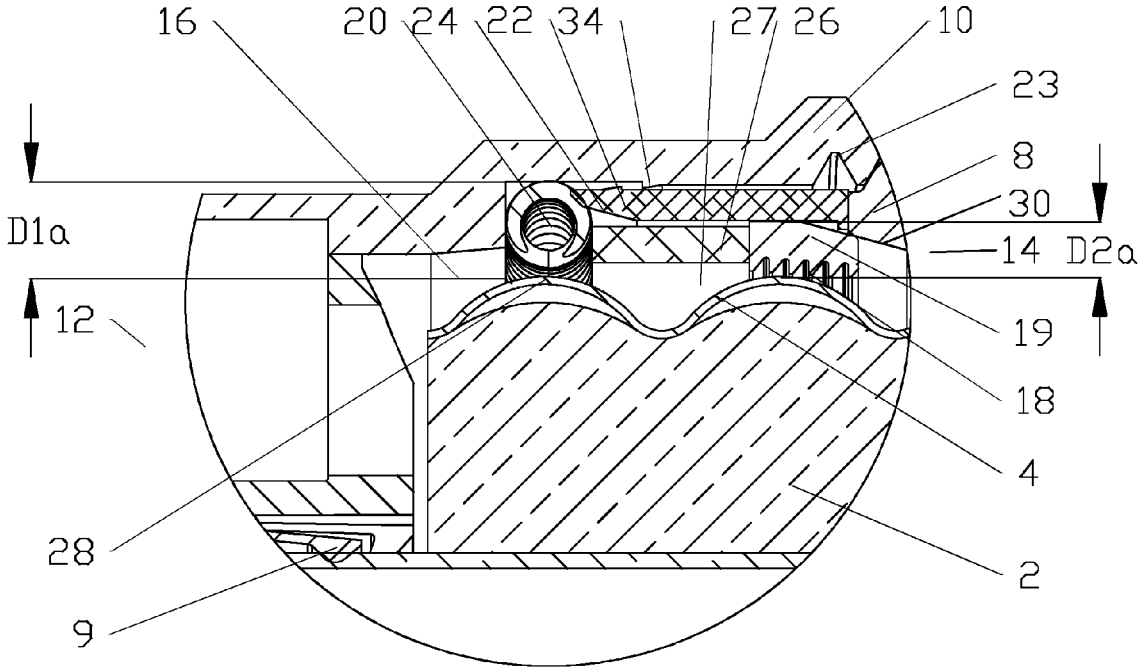
FIG. 2*a* is a schematic close up cutaway side view of the electrical connector of FIG. 1.
Figure 2B:
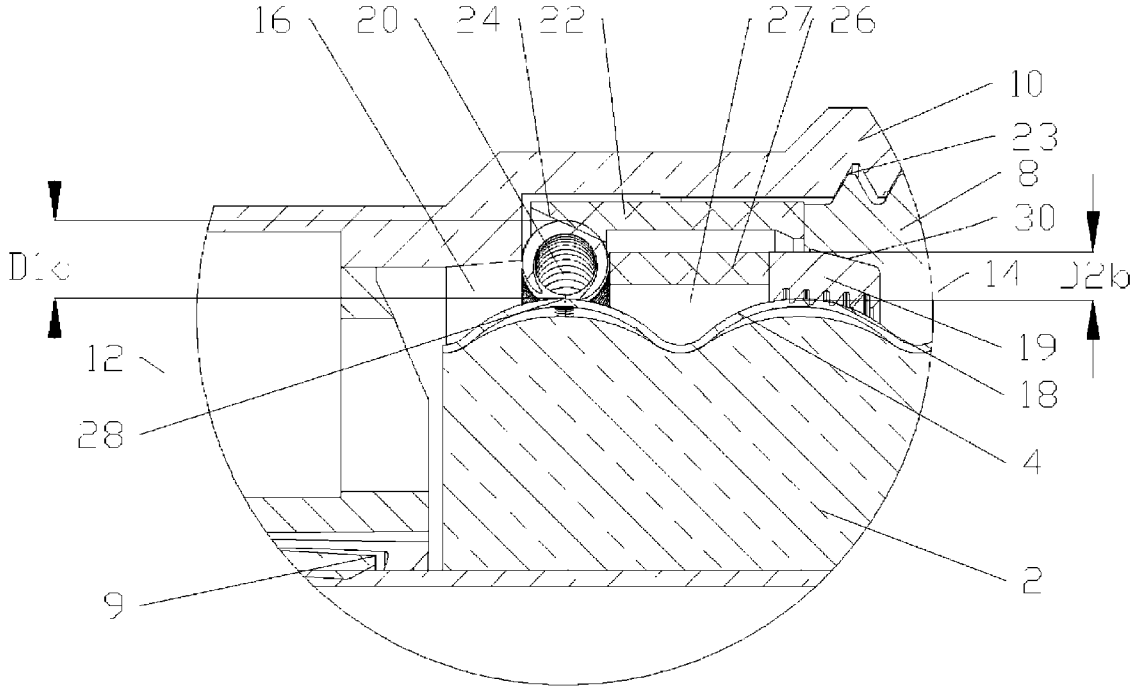
FIG. 2*b* is a schematic close up cutaway side view of the electrical connector of FIG. 1, demonstrated installed upon a minimum diameter coaxial cable.
Figure 2C:
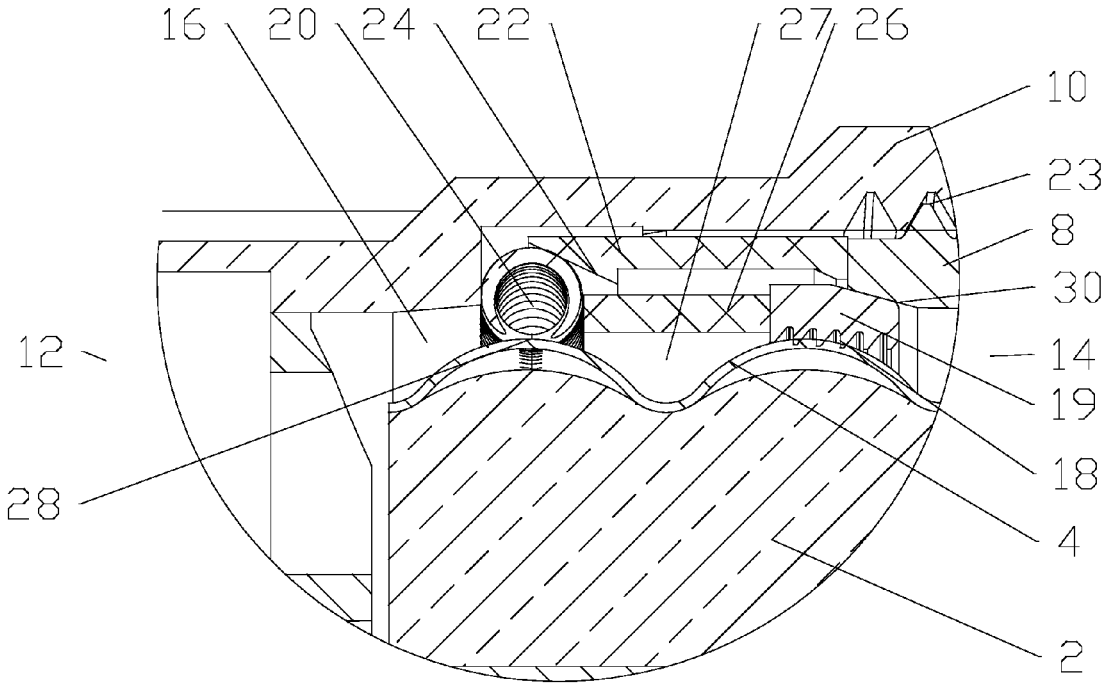
FIG. 2*c* is a schematic close up cutaway side view of the electrical connector of FIG. 1, demonstrated installed upon a minimum diameter coaxial cable.
Figure 3:
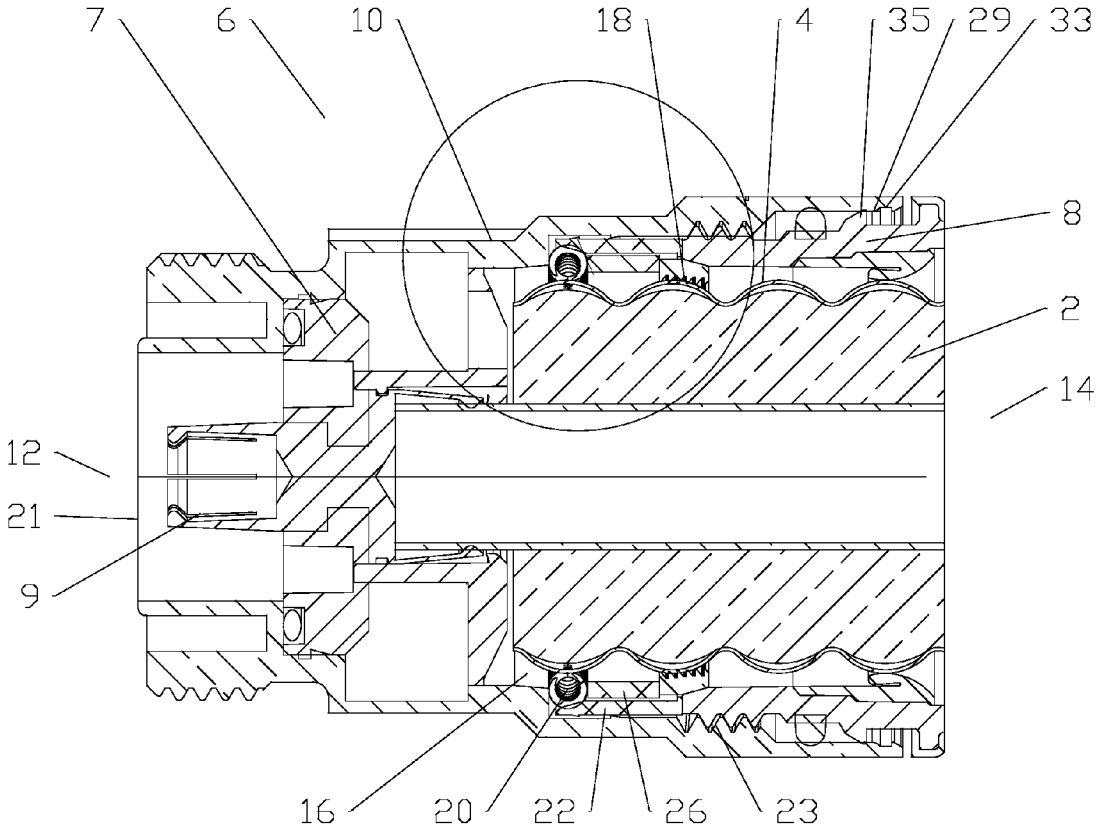
FIG. 3 is a schematic cutaway side view of the electrical connector of FIG. 1 with a minimum diameter coaxial cable inserted and a clamp ring advancing a gauge sleeve longitudinally toward the connector end.
Figure 4:
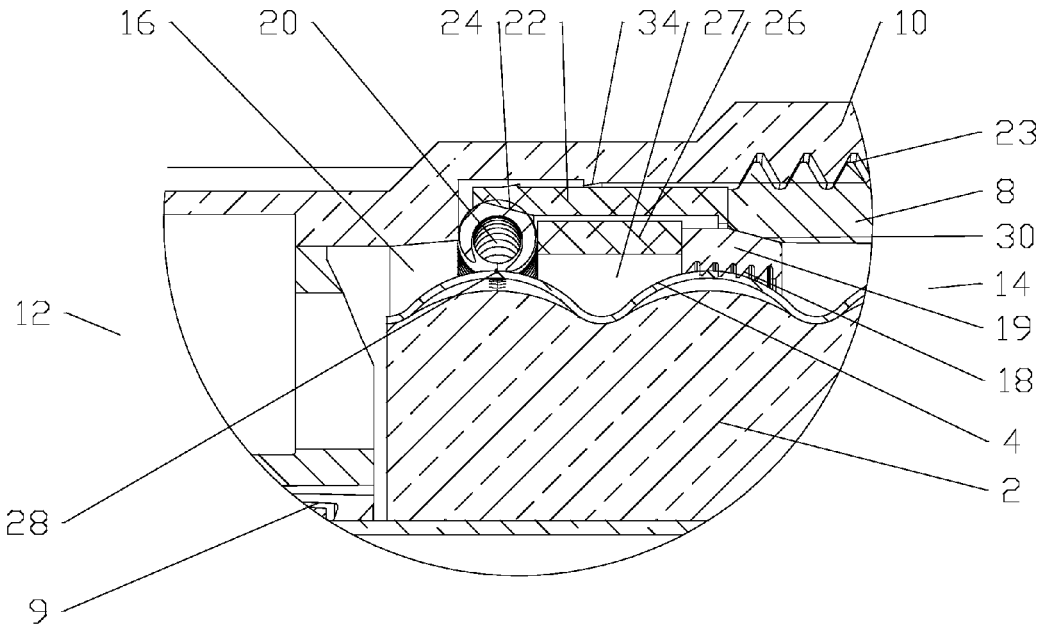
FIG. 4 is a schematic close up cutaway side view of the electrical connector of FIG. 3.

The inventors have analyzed available solid outer conductor coaxial connectors and recognized the drawbacks of threaded inter-body connection(s), manual flaring installation procedures and crimp/compression coaxial connector designs. Insertion coupling coaxial connectors, for example as disclosed in the inventor's commonly owned U.S. Utility patent application Ser. No. 12/264,932, titled "Insertion Coupling Coaxial Connector", filed Nov. 5, 2008, currently pending and hereby incorporated by reference in its entirety, introduces several significant improvements to the coaxial connector arts, eliminating the need for manual flaring of the outer conductor and/or high torque threading of the coupling nut into the connector body during outer conductor end clamping connector to cable end interconnection. Similarly, several improvements to the insertion coupling coaxial connector are disclosed in the inventors commonly owned U.S. Utility patent application Ser. No. 12/611,095, titled "Insertion Coupling Coaxial Connector", filed Nov. 2, 2009, currently pending, hereby incorporated by reference in its entirety.

One skilled in the art will appreciate that the outer diameter of coaxial cables can vary. For example, the outer diameter of a coaxial cable made by one manufacturer may differ from the outer diameter of a coaxial cable made by another manufacturer. The inventor's electrical performance analysis of the prior insertion coupling coaxial connectors has recognized that a variance in the diameter of the outer conductor of a coaxial cable can negatively impact the quality of the electrical interconnection formed via contact between a helical spring coil outer conductor electrical contact and the outer conductor.

As shown in a first exemplary embodiment in FIGS. 1-4, an insertion coupling type coaxial connector 6 has a connector body 10 with a connector body bore 16. An insulator 7 seated within the connector body bore 5 supports an inner contact 9 coaxial with the connector body bore 16. The coaxial connector 1 mechanically retains the outer conductor 4 of a coaxial cable 2 inserted into the cable end 14 of the connector body bore 16 via a mechanical grip provided by a grip surface 18 located on the inner diameter of a grip ring 19, the grip surface 18 driven radially inward by interaction of the grip ring 19 with a wedge surface 30. An electrical contact 20, herein demonstrated as a helical coil spring, seated within the connector body bore 5 makes circumferential contact with the outer conductor 4, proximate the end of the outer conductor 4, electrically coupling the outer conductor 4 across the connector body 3 to a connector interface 21 at the connector end 12.

The connector interface 21 may be any desired standard or proprietary interface.

One skilled in the art will appreciate that the cable end 14 and the connector end 12 are descriptors used herein to clarify longitudinal locations and contacting interrelationships between the various elements of the coaxial connector 1. In addition to the identified positions in relation to adjacent elements along the coaxial connector longitudinal axis, each individual element has a cable end side and a connector end side, i.e. the sides of the respective element that are facing the respective cable end 14 and the connector end 12 of the coaxial connector 1.

The grip ring 19 may be retained within the connector body bore 5, for example seated within a grip ring groove 27. For ease of grip ring 19 installation (and further elements, if present, described herein below) and/or enhanced grip ring 19 to outer conductor 4 gripping characteristics, the grip ring groove 27 may be formed wherein the cable end grip ring groove sidewall and/or bottom are surfaces of a clamp ring 8 coupled to the connector body 10, for example, via threads 23.

The clamp ring 8, may be retained upon the connector body 3 by a retaining feature 29, such as an interlock between snap barb(s) 35 provided on the outer diameter of the clamp ring 8 and one or more corresponding annular snap groove(s) 33 provided on an inner diameter of the connector body bore 5, as best shown for example in FIG. 1. Alternatively, the positions of the snap groove(s) 33 and the corresponding snap barb(s) 35 may be reversed.

As best viewed in FIGS. 2, 4, 6, 8, 10 and 13 an annular wedge surface 30 of the clamp ring 8 has a taper between a maximum diameter at a connector end side and a minimum diameter at a cable end side. An outer diameter of the grip ring 19 contacts the wedge surface 30 and is thereby driven radially inward by passage along the wedge surface 30 towards the cable end 15.

The spreading/contracting variable diameter characteristic of the grip ring 19 as the wedge surface 30 is traversed axially and/or any manufacturer variances in the diameter of the coaxial cable outer conductor 4 are encountered requires a gap along the circumference of the grip ring 19. A width of the gap may be selected in view of a differential between the maximum and minimum diameter the grip ring 19 is expected to provide.

The grip surface 18 of the grip ring 19 has a directional bias, for example via an angled face on a cable end side and a stop face on the connector end side of a plurality of annular or helical protrusions, engaging and gripping the outer diameter surface of the outer conductor 4 when in tension toward the cable end 14 while allowing the outer conductor 4 to slide past the grip surface 18 when moved toward the connector end 12.

The grip ring 19 has a range of longitudinal movement within the grip ring groove 27. As the grip ring 19 moves along the wedge surface 30 toward the connector end 12, for example as the leading edge of the outer conductor 4 is inserted into the connector body bore 5 from the cable end 15 and contacts the angled grip surface 18, the grip ring 19 will either spread to allow the outer conductor 4 to pass through, or will also begin to move longitudinally towards the connector end 12, within the grip ring groove 27. Because of the wedge surface 30 taper, as the grip ring 19 moves towards the connector end 12, the depth of the grip ring groove 27 with respect to the grip ring 19 increases. Thereby, the grip ring 19 may be spread radially outward to enable the passage of the outer conductor 4 through the grip ring 19 and toward the connector end 12. Conversely, once spread, the bias of the grip ring 19 inward toward its relaxed state creates a gripping engagement between the grip surface 18 and the outer diameter surface of the outer conductor 4. If tension is applied between the connector body 3 and the coaxial cable 2 to pull the outer conductor 4 toward the cable end 14, the grip ring 19 is driven against the tapered wedge surface 30, progressively decreasing the depth of the grip ring groove 27, thereby driving the grip ring 19 radially inward and further increasing the gripping engagement as the grip surface 18 is driven into the outer diameter surface of the outer conductor 4. Alternatively, as the clamp ring 8 is threaded into the connector body 10 via threads 23, the lateral position of the wedge surface 30 moves progressively towards the connector end 12, eventually driving the grip ring 19 against the wedge surface 30 with the same gripping engagement result.

The grip ring groove connector end sidewall lateral position, dimensions of the electrical contact 20, and any offsets or spacers also present in the grip ring groove 27 may be dimensioned to allow a range of travel where the resulting grip ring radial inward movement/diameter relative to the expected range of outer conductor diameters is configured for the grip surface 18 to have securely engaged the outer conductor 4 but which is short of a grip ring radial inward movement capable of causing the outer conductor 4 to collapse radially inward beyond an acceptable level.

One skilled in the art will appreciate that, within a normal range of attachment force, such as manual hand threading of the clamp ring 8 into the connector body 10 by installation personnel, a final lateral position of the grip ring 19 along the wedge surface 30 is dependent upon a diameter of the outer conductor 4. For example, FIG. 2 demonstrates an initial position prior to advance of the clamp ring 8 and FIG. 4 demonstrates a final position resulting from a minimum outer diameter outer conductor 4. Thereby, variances with respect to the diameter of the outer conductor 4 are accommodated by the mechanical grip.

To provide outer conductor diameter accommodation with respect to the electrical contact 20, proportional to a final radially inward displacement position of the grip ring 19 along the wedge surface 30, a ramp surface 24 coupled with the electrical contact, may be applied.

Again referring to FIGS. 1-4, the ramp surface 24 may be provided, for example, on the connector end 12 of a gauge sleeve 22 positioned between the clamp ring 8 and the electrical contact 20. The ramp surface 24 has a taper with a maximum diameter at the connector end side and a minimum diameter at the cable end side. As the clamp ring 8 is threaded into the connector body 10, the connector end 12 of the clamp ring 8 drives the gauge sleeve 22 progressively toward the connector end 12, the ramp surface 24 engaging and displacing the electrical contact 20 radially inward relative to the longitudinal position of the clamp ring 8.

An annular spacer 26 may be applied between the grip ring 19 and the electrical contact 20 to provide a cable end sidewall for the electrical contact 20, so that, as the electrical contact 20 is displaced radially inward, the electrical contact 20 biases against the outer conductor 4 rather than merely expanding laterally. Further, the spacer 26 along with the connector body 10 and clamp ring 8 may be configured to position the electrical contact 20 and the mechanical grip laterally, for example so that each engages a corrugation peak 28 of the outer conductor 4.

The electrical contact 20 has a spring/elastic compressibility characteristic which creates a secure electrical interconnection resistant to degradation resulting from, for example, vibration and/or thermal expansion cycling of the coaxial connector 6/coaxial cable 4. In view of the spring/elastic compressibility characteristic of the electrical contact 20, the advance of the clamp ring 8 may be limited by the radially inward position of the mechanical grip driven by the wedge surface 30 into contact with the outer conductor 4. The lateral advance of the clamp ring 8 toward the connector body 10 and/or attempted withdrawal of the inserted coaxial cable 2 towards the cable end 14 displaces the mechanical grip radially inward a first distance to a position corresponding to an outer diameter of the outer conductor 4 and also defines a final position of the clamp ring 8, resulting in a displacement of the electrical contact 20 radial inward a second distance proportional to the mechanical grip radial displacement. Thereby, both the mechanical grip and the electrical contact 20 are displaceable radially inward to securely engage the outer conductor 4, responsive to variability of the outer conductor 4 diameter within a defined range.

One skilled in the art will appreciate that where the tapers of the wedge surface 30 and ramp surface 24 are the same angle, the first distance and the second distance will be equal. Alternatively, in view of the compressibility of the electrical contact 20, the respective tapers may be arranged wherein the second distance is greater than the first distance, providing ease of initial coaxial cable insertion into the connector body bore 16 and enhanced final electrical contact compression into contact with the outer conductor 4.

Figure 5:
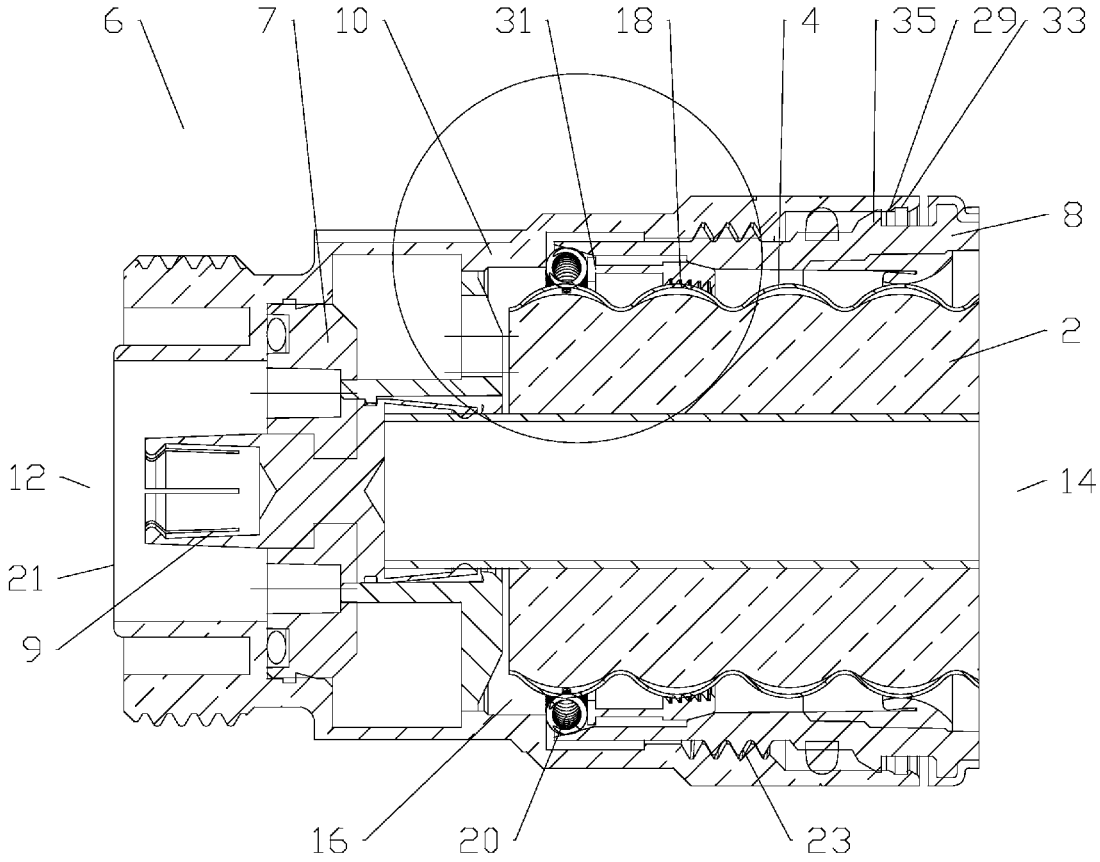
FIG. 5 is a schematic cutaway side view of another exemplary embodiment of an electrical connector with a minimum diameter coaxial cable inserted and a clamp ring advancing longitudinally toward the connector end.
Figure 6:
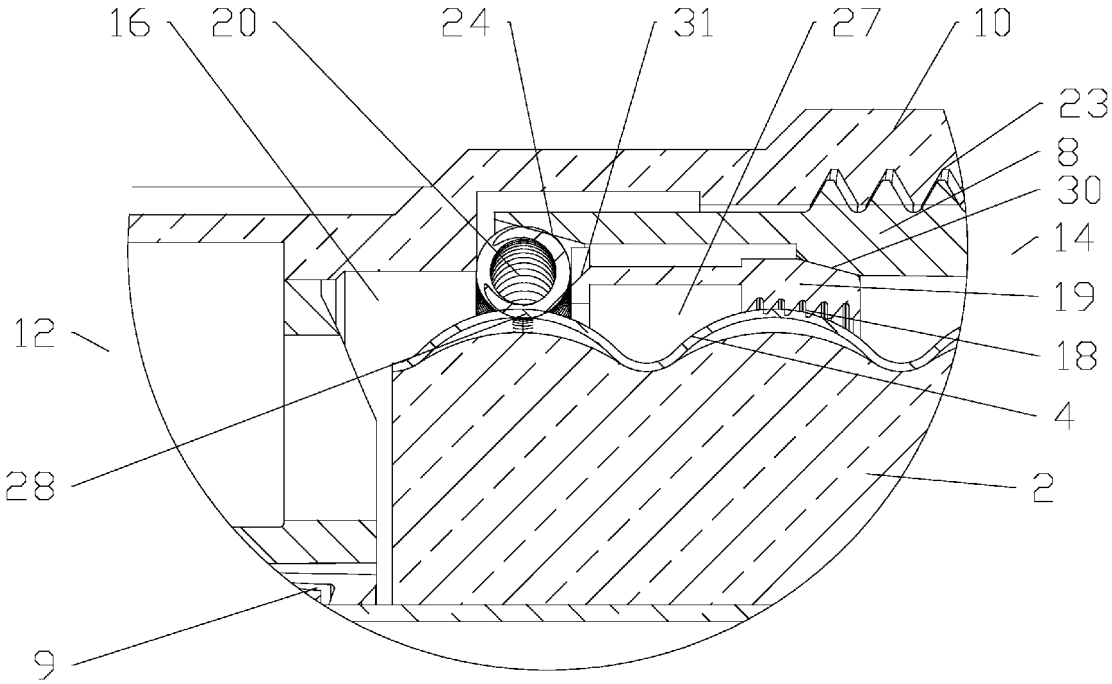
FIG. 6 is a schematic close up cutaway side view of the electrical connector of FIG. 5.

In an alternative embodiment, as shown in FIGS. 5 and 6, the ramp surface 24 may be integrated with the clamp ring 8, eliminating the need for a separate gauge sleeve 22. Similarly, the grip ring 19 may be provided with an extension 31 contacting the electrical contact 20 at the desired displacement, eliminating the spacer 26.

Figure 7:
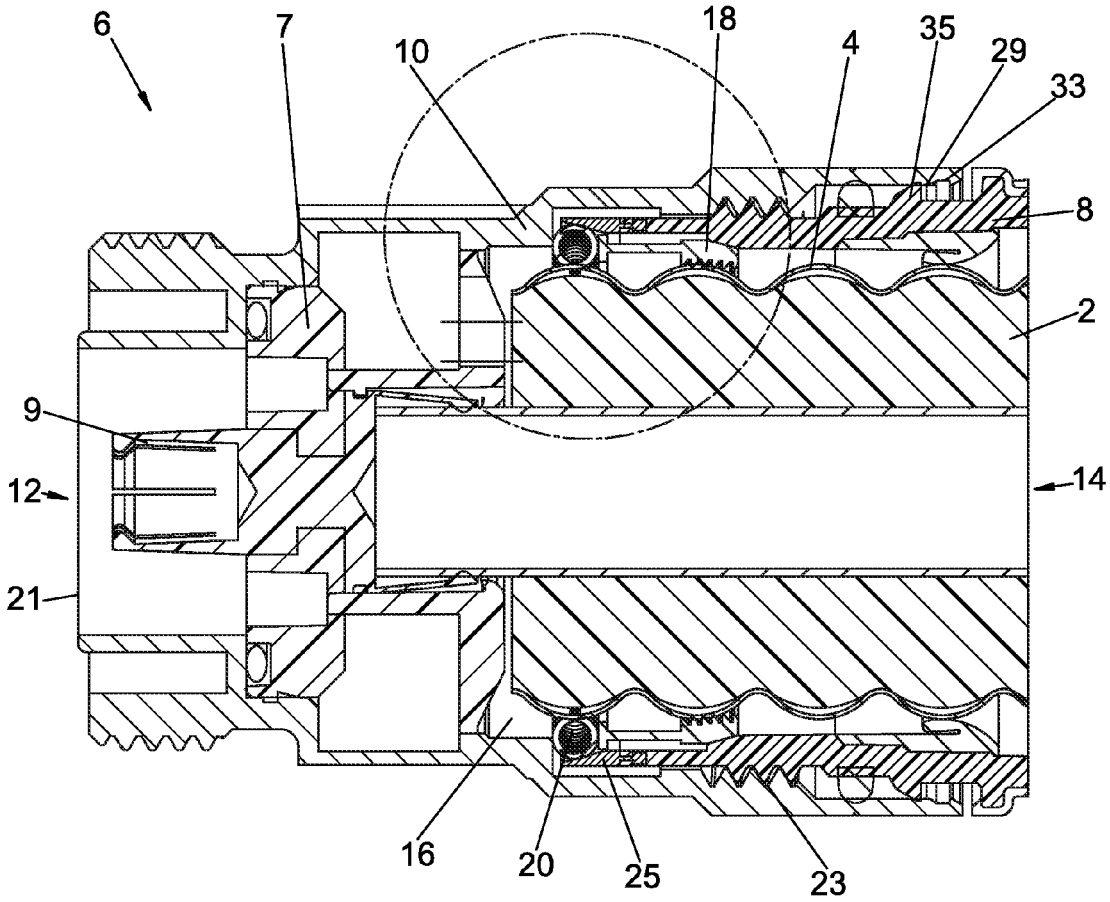
FIG. 7 is a schematic cutaway side view of another exemplary embodiment of an electrical connector with a minimum diameter coaxial cable inserted and a clamp ring advancing longitudinally toward the connector end.
Figure 8:
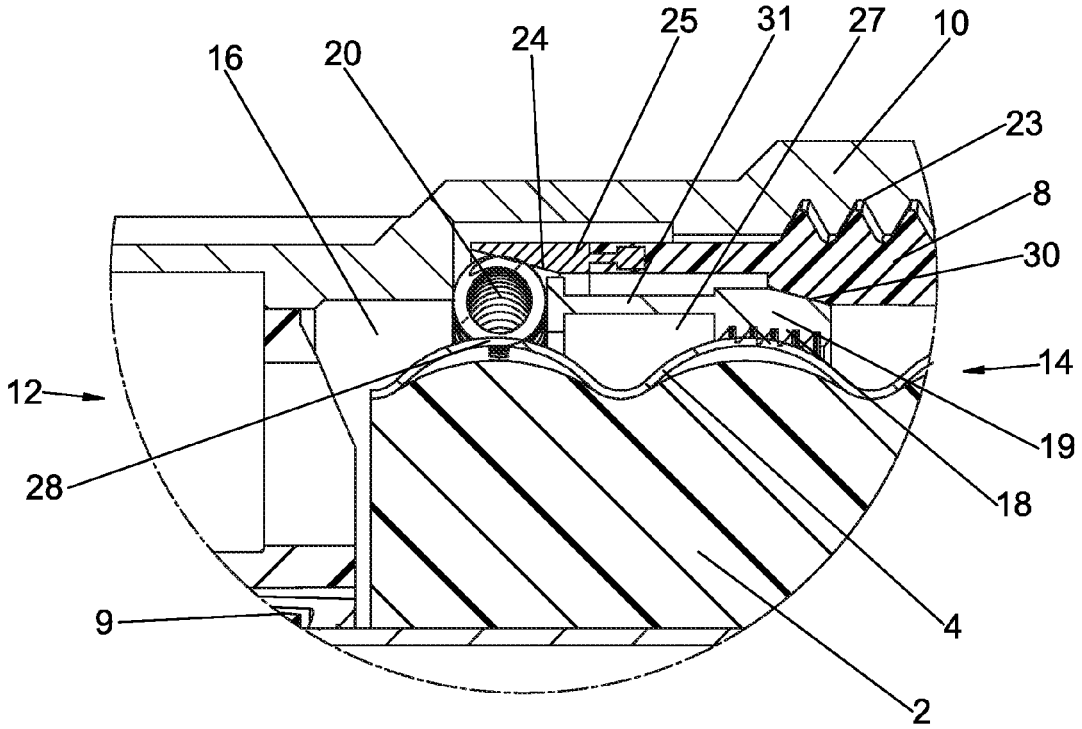
FIG. 8 is a schematic close up cutaway side view of the electrical connector of FIG. 7.

The ramp surface 24 is preferably formed from a metal material to prevent scoring and/or polymer creep where the ramp surface 24 contacts the electrical contact 20. To enable cost efficient manufacture of the clamp ring 8 of polymeric material, the cable end 14 of a metal ramp pre-form 25 may be overmolded with polymeric material to provide a clamp ring 8 of polymeric material integral with a metal ramp surface 24, for example as shown in FIGS. 7 and 8.

Figure 9:
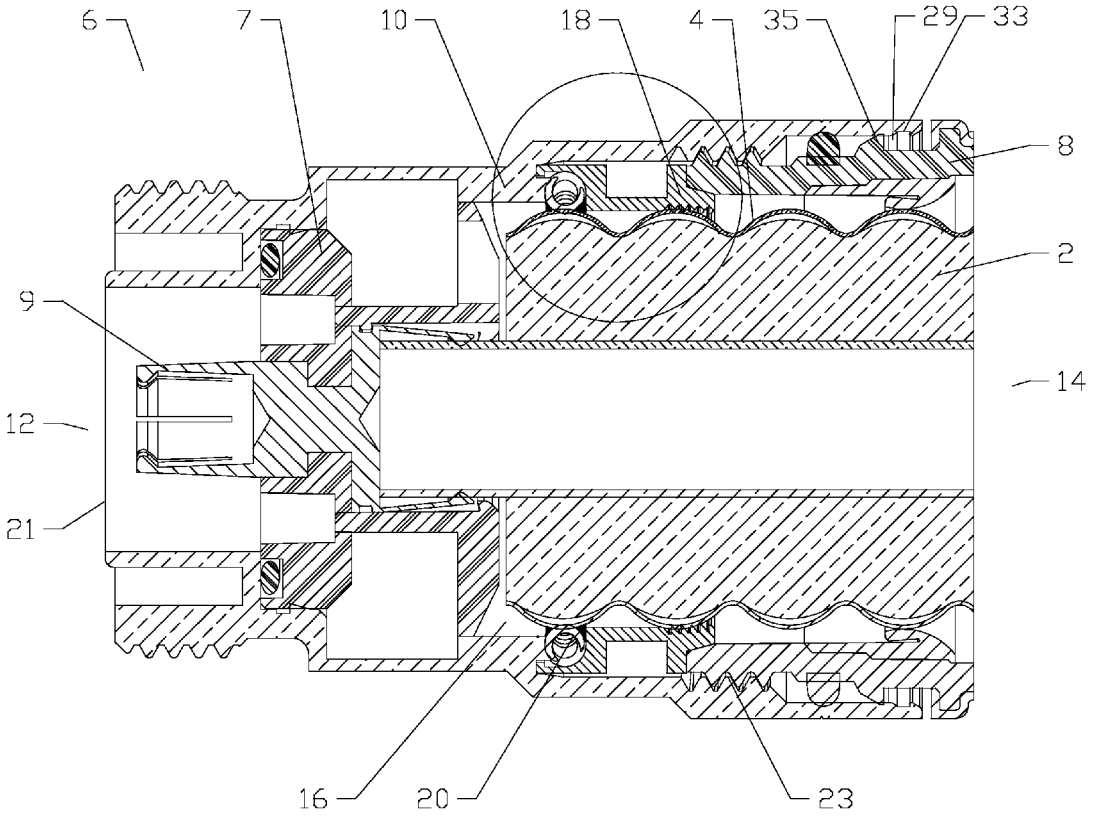
FIG. 9 is a schematic cutaway side view of another exemplary embodiment of an electrical connector with a minimum diameter coaxial cable inserted and a clamp ring advancing longitudinally towards the connector end.
Figure 10:
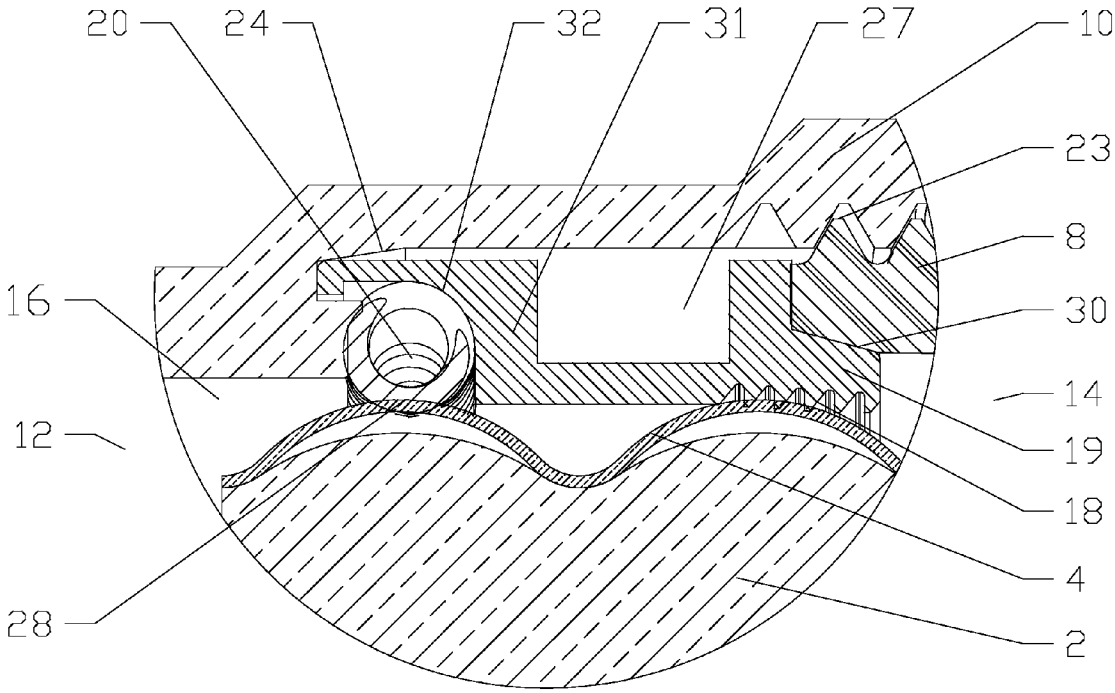
FIG. 10 is a schematic close up cutaway side view of the electrical connector of FIG. 9.
Figure 11:
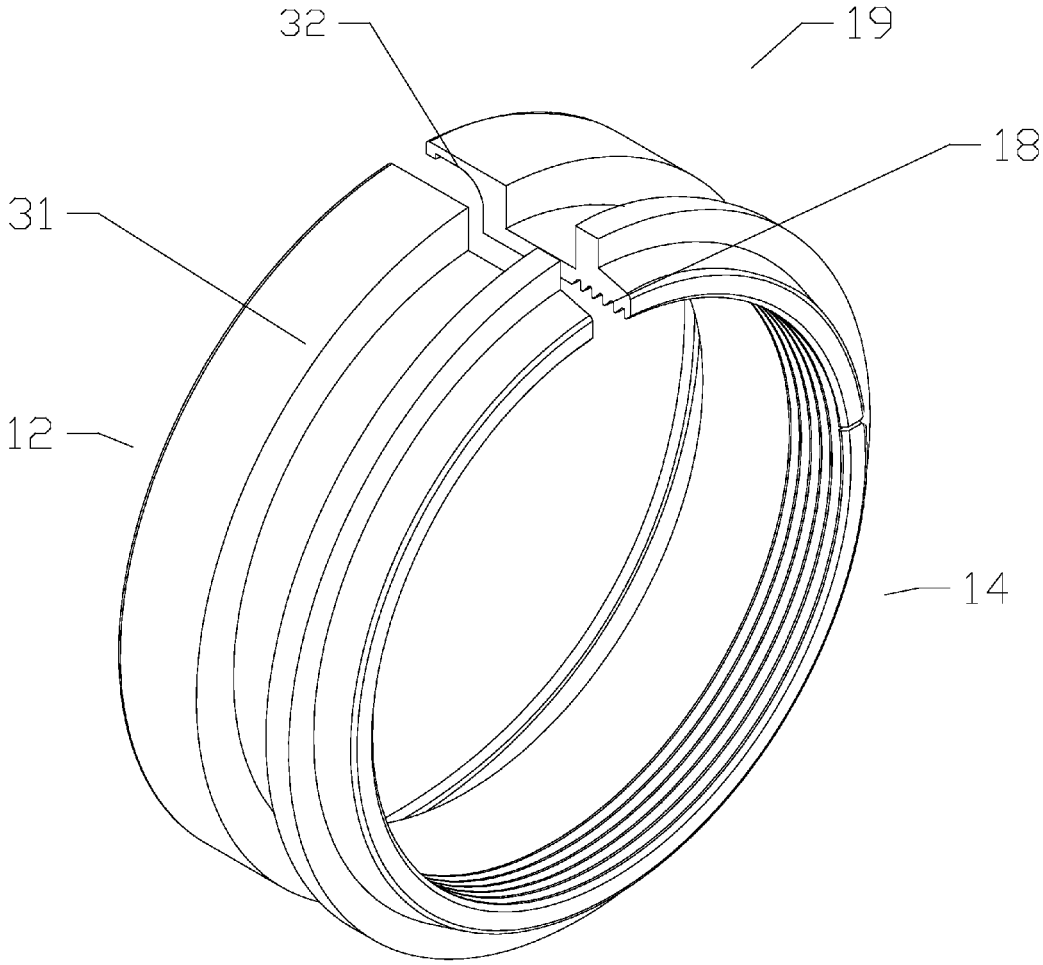
FIG. 11 is a schematic isometric angled view of the grip ring of the electrical connector of FIG. 10.
Figure 12:
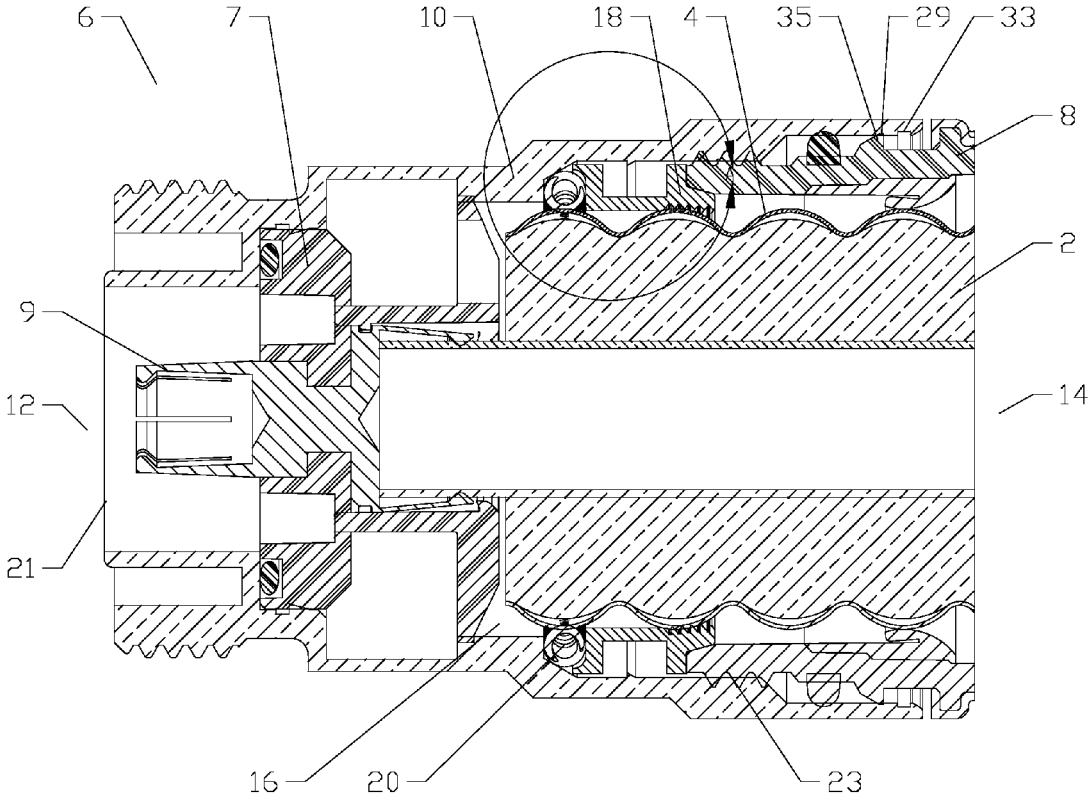
FIG. 12 is a schematic cutaway side view of another exemplary embodiment of an electrical connector with a minimum diameter coaxial cable inserted and a clamp ring advancing longitudinally towards the connector end.
Figure 13:
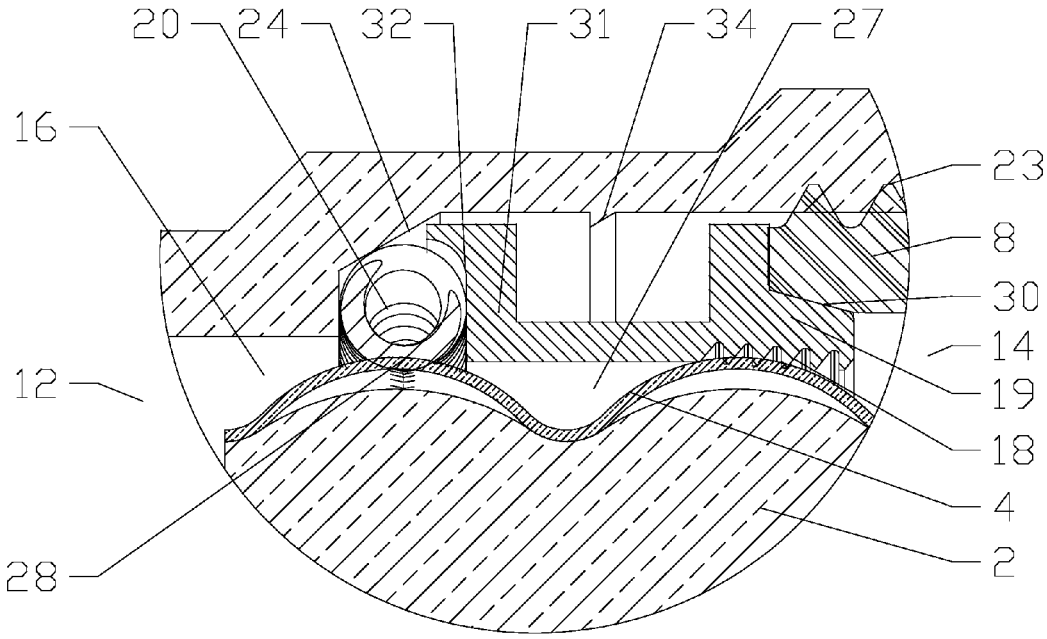
FIG. 13 is a schematic close up cutaway side view of the electrical connector of FIG. 12.

In another embodiment, for example as shown in FIGS. 9 and 10, the ramp surface 24 may be applied to an inner diameter of the connector body bore 16 and the extension 31 of the grip ring 19 provided with a seating surface 32 positioned to cradle the outer diameter of the electrical contact 20. As the grip ring 19, best shown in FIG. 11, moves laterally along the wedge surface 30, a connector end 12 of the grip ring 19 also travels along the ramp surface 24. Thereby, as the grip ring 19 moves radially inward to engage the outer conductor 4, the electrical contact 20 is also moved radially inward. In another embodiment, as shown in FIGS. 12 and 13, the seating surface 32 may be configured to only partially cradle the electrical contact 20. As the grip ring 19 moves laterally and radially inward with respect to the wedge surface 30, the electrical contact 20 is driven by the seating surface 32 against the ramp surface 24, and thus radially inward. Thereby, as the grip ring 19 moves radially inward to engage the outer conductor 4, the electrical contact 20 is also moved radially inward.

A retaining lip 34 may be applied to the connector body bore 16 sidewall to retain the grip ring 19 (or gauge sleeve 22, if present) and thereby the electrical contact 20 until the clamp ring 8 is installed.

One skilled in the art will appreciate that an insertion coupling coaxial connector 6 where both the mechanical grip securely retaining the outer conductor 4 within the connector body 10 and the electrical contact 20 electrically interconnecting the outer conductor 4 with the connector body 10 are adaptable to a range of outer conductor diameters provides significant improvements in universality and/or interchangeability, enabling ready exchange upon existing coaxial cable installations during repairs/upgrades and/or new installations wherein coaxial cables from multiple sources are present.

Table of Parts

| | |
|---|---|
| 2 | coaxial cable |
| 4 | outer conductor |
| 6 | coaxial connector |
| 7 | insulator |
| 8 | clamp ring |
| 9 | inner contact |
| 10 | connector body |
| 12 | connector end |
| 14 | cable end |
| 16 | connector body bore |
| 18 | grip surface |
| 19 | grip ring |
| 20 | electrical contact |
| 21 | connector interface |

-continued

| Table of Parts | |
|---|---|
| 22 | gauge sleeve |
| 23 | threads |
| 24 | ramp surface |
| 25 | ramp pre-form |
| 26 | spacer |
| 27 | grip ring groove |
| 28 | corrugation peak |
| 29 | retaining feature |
| 30 | wedge surface |
| 31 | extension |
| 32 | seating surface |
| 33 | snap grooves |
| 34 | retaining lip |
| 35 | snap barb |

Where in the foregoing description reference has been made to materials, ratios, integers or components having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A coaxial connector with a connector end and a cable end for coupling with a coaxial cable with a solid outer conductor, the connector comprising:

a connector body provided with a connector body bore;

a clamp ring coupled to the cable end of the connector body;

a grip ring retained within the bore;

an outer diameter of the grip ring abutting an annular wedge surface of the clamp ring;

the wedge surface provided with a taper between a maximum diameter proximate the connector end and a minimum diameter proximate the cable end;

an inner diameter of the grip ring provided with a grip surface;

a helical coil spring retained within the connector body bore;

the connector body bore provided with a ramp surface coupled to the helical coil spring via the grip ring via a seating surface of the grip ring contacting the helical coil spring; and the grip ring abutting the ramp surface.

2. A coaxial connector with a connector end and a cable end for coupling with a coaxial cable with a solid outer conductor, the connector comprising:

a connector body provided with a bore;

a clamp ring coupled to a cable end of the connector body;

a grip ring and a helical coil spring within the bore, the helical coil spring positioned at the cable end side of the grip ring;

a lateral advance of the clamp ring towards the connector body driving the grip ring radial inward, to contact the outer conductor, a first distance corresponding to an outer diameter of the outer conductor and the helical coil spring radial inward, to contact the outer conductor, a second distance proportional to the first distance the helical coil spring contacting a ramp surface provided on one of: a) the clamp ring; and b) a gauge sleeve between the clamp ring and the helical coil spring.

3. The connector of claim 2, wherein the first distance is generally equal to the second distance.

4. The connector of claim 2, wherein the first distance is less than the second distance.

5. The connector of claim 2, further including an annular spacer within the bore between the helical coil spring and the grip ring; the annular spacer dimensioned longitudinally to align the helical coil spring and the grip each with a corrugation peak of the outer conductor.

6. The connector of claim 2, further including an outer diameter of the grip ring abutting an annular wedge surface of the clamp ring;

the wedge surface provided with a taper between a maximum diameter proximate the connector end and a minimum diameter proximate the cable end;

an inner diameter of the grip ring provided with a grip surface.

7. A coaxial cable connector with a connector end and a cable end for coupling with a coaxial cable with a solid outer conductor, the connector comprising:

a connector body provided with a bore;

a clamp ring coupled to the cable end of the connector body;

a grip ring retained within the bore, an inner diameter of the grip ring provided with a grip surface, an outer diameter of the grip ring abutting a wedge surface of the clamp ring;

the wedge surface provided with a taper between a maximum diameter proximate the connector end and a minimum diameter proximate the cable end;

an electrical contact retained within the bore;

the grip surface and an inner diameter of the electrical contact dimensioned to receive the outer conductor from the cable end therethrough and couple with an outer diameter of the outer conductor;

a ramp surface coupled to the electrical contact, the ramp surface driving the electrical contact radial inward;

the clamp ring is a metal ramp surface pre-form overmolded at the cable end with polymeric material, the ramp surface provided proximate a connector end of the ramp surface pre-form.

8. A coaxial cable connector with a connector end and a cable end for coupling with a coaxial cable with a solid outer conductor, the connector comprising:

a connector body provided with a bore;

a clamp ring coupled to the cable end of the connector body;

a grip ring retained within the bore, an inner diameter of the grip ring provided with a grip surface, an outer diameter of the grip ring abutting a wedge surface of the clamp ring;

the wedge surface provided with a taper between a maximum diameter proximate the connector end and a minimum diameter proximate the cable end;

an electrical contact retained within the bore;

the grip surface and an inner diameter of the electrical contact dimensioned to receive the outer conductor from the cable end therethrough and couple with an outer diameter of the outer conductor;

a ramp surface coupled to the electrical contact, the ramp surface driving the electrical contact radial inward;

the ramp surface is provided proximate a connector end of a gauge sleeve; and the connector end of the clamp ring abutting a cable end of the gauge sleeve.

9. The connector of claim 8, further including an annular spacer within the bore, between the electrical contact and the grip ring.

10. The connector of claim 9, wherein the annular spacer is dimensioned longitudinally to align the electrical contact and the grip ring each with a corrugation peak of the outer conductor.

11. A coaxial cable connector with a connector end and a cable end for coupling with a coaxial cable with a solid outer conductor, the connector comprising:

a connector body provided with a bore;

a clamp ring coupled to the cable end of the connector body;

a grip ring retained within the bore, an inner diameter of the grip ring provided with a grip surface, an outer diameter of the grip ring abutting a wedge surface of the clamp ring;

the wedge surface provided with a taper between a maximum diameter proximate the connector end and a minimum diameter proximate the cable end;

an electrical contact retained within the bore;

the grip surface and an inner diameter of the electrical contact dimensioned to receive the outer conductor from the cable end therethrough and couple with an outer diameter of the outer conductor;

a ramp surface coupled to the electrical contact, the ramp surface driving the electrical contact radial inward;

the ramp surface is a sidewall portion of the bore; the grip ring provided with a seating surface contacting the electrical contact; and the grip ring abutting the ramp surface.

12. The connector of claim 11, wherein a connector end of the grip ring contacts the electrical contact.

13. The connector of claim 11, wherein the wedge surface is formed in an inner diameter of the clamp ring, proximate the connector end of the clamp ring.

14. The connector of claim 11, further including a thread between the connector body and the clamp ring; and the thread operable to advance the wedge surface axially towards the connector end of the connector.

15. The connector of claim 11, wherein the electrical contact is an annular helical coil spring.

* * * * *